United States Patent [19]

Vock

[11] 4,163,614

[45] Aug. 7, 1979

[54] CLOSED LOOP PARTICLE DISPENSER

[75] Inventor: Richard C. Vock, Ontario, N.Y.

[73] Assignee: Xerox Corporation, Stamford, Conn.

[21] Appl. No.: 859,414

[22] Filed: Dec. 12, 1977

[51] Int. Cl.[2] ..... G03G 15/00

[52] U.S. Cl. ..... 355/3 DD; 118/653; 222/DIG. 1; 222/318

[58] Field of Search ..... 355/3 R, 3 DD; 118/646, 118/653; 222/DIG. 1, 318

[56] References Cited

U.S. PATENT DOCUMENTS

| | | | |
|---|---|---|---|
| 3,244,325 | 4/1966 | Lindquist | 222/DIG. 1 X |
| 3,752,576 | 8/1973 | Gerbasi | 118/646 X |
| 3,760,990 | 9/1973 | Lindquist | 222/DIG. 1 X |
| 3,948,217 | 4/1976 | Forward | 355/3 DD X |
| 3,951,539 | 4/1976 | Draugelis | 355/3 DD |

OTHER PUBLICATIONS

Jendrick, R. J.; "Toner Dispenser"; Xerox Disclosure Journal; vol. 1, No. 1, Jan. 1976; p. 65.

*Primary Examiner*—Fred L. Braun

*Attorney, Agent, or Firm*—J. J. Ralabate; C. A. Green; H. Fleischer

[57] ABSTRACT

An apparatus in which toner particles are discharged into a developer material. A helical auger moves the toner particles through a tube having substantially equally spaced apertures therein. The toner particles are dispensed from the tube with the nondispensed toner particles being returned to the toner particle supply hopper.

1 Claim, 3 Drawing Figures

CLOSED LOOP PARTICLE DISPENSER

BACKGROUND OF THE INVENTION

This invention relates generally to an electrophotographic printing machine, and more particularly concerns an improved apparatus for dispensing toner particles.

In electrophotographic printing, a photoconductive member is charged to sensitize the surface thereof. The charged portion of the photoconductive surface is exposed to a light image of an original document being reproduced. Exposure of the sensitized photoconductive surface discharges the charge selectively. This records an electrostatic latent image on the photoconductive surface corresponding to the informational areas contained within the original document being reproduced. Development of the electrostatic latent image recorded on the photoconductive surface is achieved by bringing a developer material into contact therewith. Typical developer materials comprise dyed or colored heat settable plastic powders, known in the art as toner particles, which are mixed with coarser carrier granules, e.g. ferromagnetic granules. The carrier granules have the toner particles adhering to and coating the surface thereof due to the triboelectric attraction therebetween. During development, the carrier granules with the toner particles adhering thereto contact the electrostatic latent image. The electrostatic latent image has a charge of opposite polarity to the charge on the toner particles. The toner particles are pulled away from the carrier granules by the latent image and deposited thereon to form a powder image. The partially denuded carrier granules return to the developer sump. As toner powder images are formed, additional toner particles must be furnished to the developer mixture in proportion to the amount of toner deposited on the latent images.

If prints made by the electrophotographic printing process have heavy deposits of toner particles in image areas of good contrast and non-image areas having a gray background, the toner concentration in the developer mixture is too great. Contrawise, if the prints have low contrast images, the quantity of toner particles in the developer mixture is insufficient. In order to continually obtain prints of good quality, the quantity of toner particles in the developer mixture must be held reasonably constant. This is achieved by the addition of toner particles to the developer mixture in proportion to the amount of toner particles deposited on the latent images.

Various methods have been devised for introducing additional toner particles to the developer mixture. However, these methods generally dump large amounts of toner particles into the mixture and do not, necessarily, uniformly disseminate them thereto. Many of the techniques employed to discharge toner particles employ gravity and control the particle flow rate from the storage reservoir. Some machine configurations do not readily permit this type of dispensing due to physical interferences of the required location of the storage reservoir with other machine components. To solve this problem, the storage reservoir is frequently located remotely in the machine and a transport system for moving the toner particles from the storage reservoir to the developer housing is provided. Uniform dispensing in this type of system is frequently difficult to achieve, particularly when the flow characteristics of the toner particles may vary, e.g. with changes in relative humidity.

Accordingly, it is a primary object of the present invention to improve the dispensing of toner particles to a developer mixture.

PRIOR ART STATEMENT

Various types of devices have hereinbefore been developed to improve toner particle dispensing. The following prior art appears to be relevant:

Swanson et al U.S. Pat. No. 3,703,957 Nov. 28, 1972
Latone U.S. Pat. No. 3,793,986 Feb. 26, 1974
UK Pat. No. 1,349,729
UK Pat. No. 1,370,715

The pertinent portions of the foregoing prior art may be briefly summarized as follows:

Swanson et al. discloses a pneumatic separator employing a plurality of blowers coupled to a vacuum type pick-up device positioned to remove loose particles from the copies as they egress from the printing machine. A centrifugal separator is positioned in the pneumatic system to receive the particle laden air from the vacuum pick-up device for separating the particles from the air. The particle separating chamber has baffles and receives the separated particles so as to return them for active use in the printing machine. A filter assembly is attached to the air outlet of the settling chamber so that the air leaving the separator is filtered prior to being returned to the atmosphere.

Latone discloses a cleaning system coupled to a reclamation system for use in electrophotographic printing. The system includes a particle separator located in the path of movement of the air flow containing the toner particles. After the toner particles have been separated, they are directed to a plurality of bottles and may be removed from the printing machine and subsequently re-used therein.

UK Pat. No. 1,349,729 describes a powder container having a tube loosely fit over a helical spring. One end of the tube is disposed in the container with the other end thereof extending into a reservoir. As the helical spring rotates, it moves the powder from the container to the reservoir.

UK Pat. No. 1,370,715 discloses a toner drive comprising a first helical spring and a second helical spring. The springs are mounted in a compartment comprising a hopper portion and a toner outlet portion. The springs extend along the hopper and outlet portions to an outlet member. The first spring is wound clockwise and advances toner from the hopper along the outlet portion through the outlet member. Any toner that is not forced through the outlet member is moved counter to the direction of flow by the second spring which is wound in a counter clockwise direction. This action prevents caking or compacting of the toner in the process of feeding toner through the outlet member.

It is believed that the scope of the present invention, as defined by the appended claims, is clearly patentably distinguishable over the foregoing prior art taken either singly or in combination with one another.

SUMMARY OF THE INVENTION

Briefly stated, and in accordance with the present invention, there is provided an apparatus for discharging particles.

Pursuant to the features of the invention, the apparatus includes means for storing a supply of particles.

Means, coupled to the storing means, dispense particles from the storing means and return the non-dispensed particles to the storing means.

BRIEF DESCRIPTION OF THE DRAWINGS

Other objects and advantages of the present invention will become apparent upon reading the following detailed description and upon reference to the drawings, in which.

While the present invention will hereinafter be described in connection with a preferred embodiment and method of use thereof, it will be understood that it is not intended to limit the invention to that embodiment or method of use. On the contrary, it is intended to cover all alternatives, modifications and equivalents as may be included within the spirit and scope of the invention as defined by the appended claims.

DETAILED DESCRIPTION OF THE INVENTION

Figure 1:
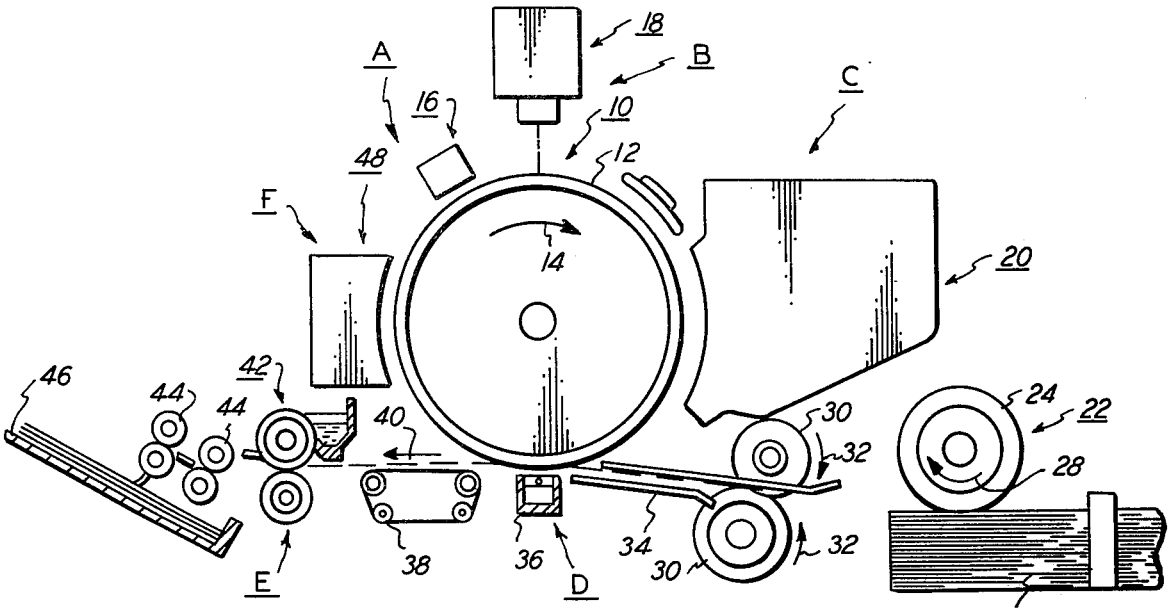
FIG. 1 illustrates a schematic elevational view of an electrophotographic printing machine incorporating the features of the present invention therein.

For a general understanding of an electrophotographic printing machine in which the features of the present invention may be incorporated, reference is had to FIG. 1 which depicts schematically the various components thereof. Hereinafter, like reference numerals will be employed throughout to designate identical elements. Although the toner dispensing apparatus is particularly well adapted for use in the development system of an electrophotographic printing machine, it should become evident from the following discussion that it is equally well suited for use in a wide variety of devices and is not necessarily limited in its application to the particular embodiment shown herein.

Inasmuch as the practice of electrophotographic printing is well known in the art, the various processing stations for producing a copy of an original document are represented in FIG. 1 schematically. Each processing station will be discussed briefly hereinafter.

As in all electrophotographic systems of the type illustrated, a drum 10 having photoconductive surface 12 entrained about and secured to the exterior circumferential surface of a conductive substrate is rotated, in the direction of arrow 14, through the various processing stations. One type of suitable photoconductive material is a selenium alloy, such as is described in U.S. Pat. No. 2,970,906 issued to Bixby in 1961. Preferably, the conductive substrate is made from aluminum or an alloy thereof.

Initially, drum 10 rotates a portion of photoconductive surface 12 through charging station A. Preferably, charging station A utilizes a corona generating device, indicated generally by the reference numeral 16, to sensitize photoconductive surface 12. Corona generating device 16 is positioned closely adjacent to photoconductive surface 12. When energized, corona generating device 16 charges at least a portion of photoconductive surface 12 to a relatively high substantially uniform potential. For example, corona generating device 16 may be of the type described in U.S. Pat. No. 2,836,725 issued to Vyverberg in 1958.

Thereafter, drum 10 rotates the charged portion of photoconductive surface 12 to exposure station B. Exposure station B includes an exposure mechanism, indicated generally by the reference numeral 18, having a stationary, transparent platen, such as a glass plate or the like, for supporting an original document thereon. Scan lamps illuminate the original document. Scanning of the original document may be achieved by oscillating a mirror in a timed relationship with the movement of drum 10. This mirror is positioned beneath the platen to reflect the light image of the original document through a lens onto a second mirror, which, in turn, transmits the light image through an apertured slit onto the charged portion of photoconductive surface 12. Irradiating the charged portion of photoconductive surface 12 selectively discharges the charge thereon to record an electrostatic latent image corresponding to the informational areas contained within the original document.

Figure 2:
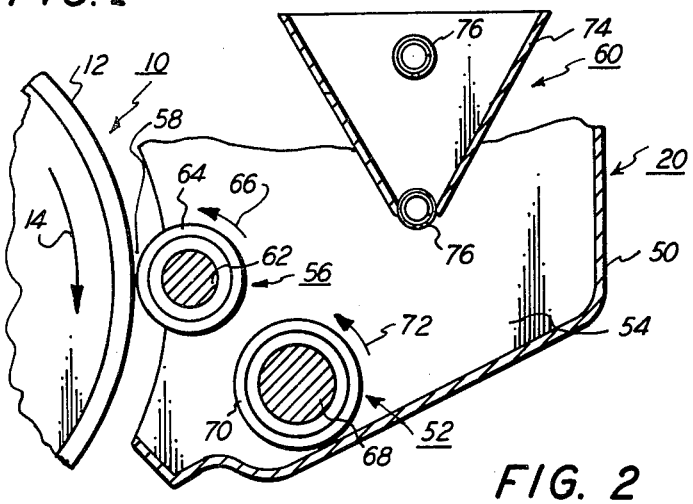
FIG. 2 depicts an elevational view of a development system employed in the FIG. 1 printing machine.
Figure 3:
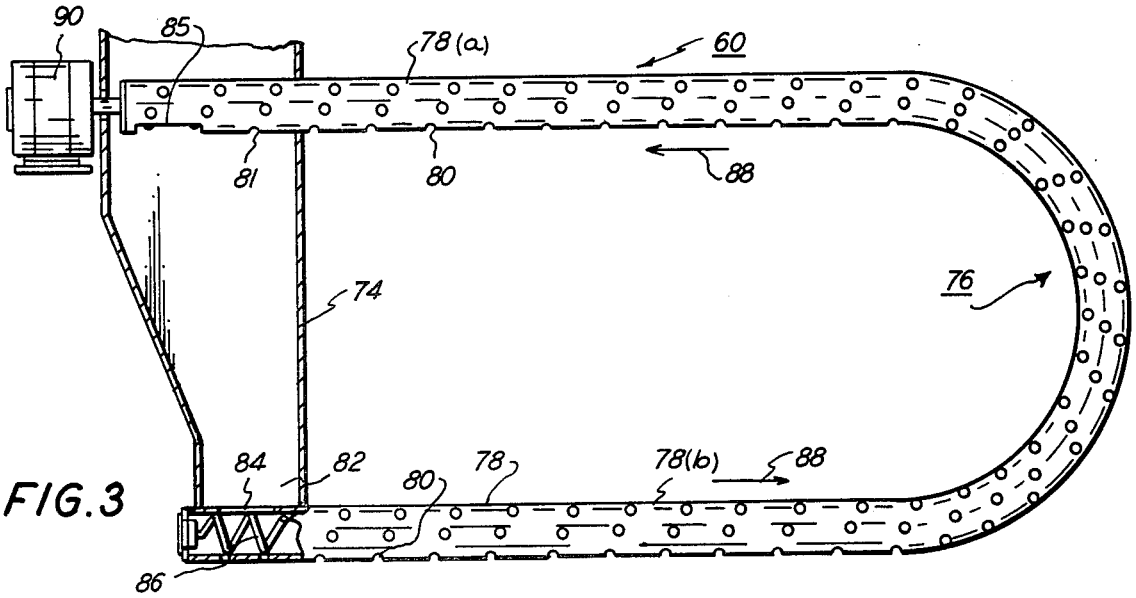
FIG. 3 shows an elevational view of a particle dispenser used in the FIG. 2 development system.

Drum 10 next rotates the electrostatic latent image recorded on photoconductive surface 12 to development station C. Development station C includes a developer unit, indicated generally by the reference numeral 20, having a housing with a supply of developer material contained therein. The developer material includes carrier granules having toner particles adhering triboelectrically thereto. Preferably, developer unit 20 is a magnetic brush type of development system. In a system of this type, the developer material is brought through a directional flux field to form a brush thereof. The electrostatic latent image recorded on photoconductive surface 12 is developed by bringing the brush of developer material into contact therewith. During development, the toner particles are attracted from the carrier granules to the latent image forming a powder image on photoconductive surface 12. The detailed structure of developer unit 20 will be described hereinafter with reference to FIG. 2. As the toner particles are depleted from the developer material, the toner dispensing apparatus supplies additional toner particles thereto. The detailed structure of the toner dispenser is illustrated in FIGS. 2 and 3.

With continued reference to FIG. 1, a sheet of support material is advanced by sheet feeding apparatus 22 to transfer station D. Sheet feeding apparatus 22 includes a feed roll 24 contacting the uppermost sheet of the stack of sheets of support material 26. Feed roll 24 rotates in the direction of arrow 28 so as to advance the uppermost sheet from stack 26. Registration rollers 30, rotating in the direction of arrow 32, align and forward the advancing sheet of support material into chute 34. Chute 34 directs the advancing sheet of support material into contact with drum 10 in a timed sequence so that the powder image developed thereon contacts the advancing sheet at transfer station D.

At transfer station D, corona generating device 36 applies a spray of ions to the backside of the sheet of support material. This attracts the powder image from photoconductive surface 12 to the sheet of support material. After transfer, the sheet is separated from photoconductive surface 12 and advanced by conveyor 38 in the direction of arrow 40 to fusing station E.

Fusing station E includes a fuser assembly, indicated generally by the reference numeral 42. Fuser assembly 42 permanently affixes the transferred toner powder image to the sheet of support material. After the toner powder image is permanently affixed to the sheet of support material, the sheet of support material is advanced by a series of rollers 44 to catch tray 46 for subsequent removal therefrom by the machine operator.

Invariably, after the sheet of support material is stripped from photoconductive surface 12 of drum 10, some residual particles remain adhering to photoconductive surface 12. These residual particles are removed from photoconductive surface 12 at cleaning station F. Cleaning station F includes a cleaning system, indicated generally by the reference numeral 48. The particles are cleaned from photoconductive surface 12 by a rotatably mounted fibrous brush in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine. Referring now to the specific subject matter of the present invention, FIG. 2 depicts developer unit 20 in greater detail.

Turning now to FIG. 2, there is shown the detailed structure of developer unit 20. As depicted therein, developer unit 20 comprises a developer housing 50 including a transport roller, indicated generally by the reference numeral 52, disposed in chamber 54 thereof. A developer roller, indicated generally by the reference numeral 56, is located in chamber 54 and receives the developer material from transport roller 52. Developer roller 56 advances the developer material into development zone 58 where it contacts photoconductive surface 12. A toner dispensing apparatus, indicated generally by the reference numeral 60, furnishes additional toner particles to the developer mix in chamber 54. Thus, as the toner particles are depleted from the developer mix during development of successive electrostatic latent images, additional toner particles are furnished thereto from toner dispensing apparatus 60.

With continued reference to FIG. 2, developer roller 56 includes a magnetic stator 62 having a plurality of magnetic poles impressed about the circumferential surface thereof. Magnetic stator 62 is cylindrical. A non-magnetic tubular member 64 is interfit telescopically over magnetic stator 62. Preferably, magnetic stator 62 is made from barium ferrite, while tubular member 64 is made from stainless steel having the exterior circumferential surface thereof roughened. In one embodiment, tubular member 64 rotates in the direction of arrow 66 while magnetic stator 62 remains substantially stationary. Alternatively, tubular member 64 may remain substantially stationary while magnetic member 62 rotates. Tubular member 64 is positioned closely adjacent to photoconductive surface 12. The gap 58 between the exterior circumferential surface of tubular member 64 and photoconductive surface 12 is optimum for developing the electrostatic latent image recorded on photoconductive surface 12.

Transport roller 52 advances the developer material from the sump of chamber 54 to developer roller 56. Transport roller 52 comprises a magnetic stator 68 having a plurality of magnetic poles impressed about the circumferential surface thereof. Magnetic stator 68 is cylindrical. A non-magnetic tubular member 70 is interfit telescopically over magnetic stator 68. Preferably, magnetic stator 68 is made from barium ferrite while tubular member 70 is made from stainless steel having the exterior circumferential surface thereof roughened. In one embodiment, tubular member 70 rotates in the direction of arrow 72 while magnetic stator 68 remains substantially stationary. Alternatively, tubular member 70 remains substantially stationary while magnetic member 68 rotates. Tubular member 70 is positioned closely adjacent to developer roller 56 so as to advance the developer material from the sump of chamber 54 thereto.

Toner dispensing apparatus 60 includes a hopper 74 storing a supply of toner particles therein. Associated with hopper 74 is a dispenser 76 for discharging the toner particles from hopper 74 to the sump of chamber 54. Dispenser 76 extends across the width of developer housing 50 and discharges the toner particles substantially uniformly therefrom. In one direction, toner particles are discharged and the non-discharged toner particles are subsequently returned to the upper region of hopper 74 for subsequent re-dispensing therefrom. The dispenser is periodically actuated to discharge the toner particles in response to the system indicating that the toner particles in the developer material are significantly depleted. One suitable type of measuring apparatus for determining the level of toner particle concentration within the developer mixture is disclosed in U.S. Pat. No. 3,754,821 issued to Whited in 1973, the relevant portions thereof being hereby incorporated into the present application. As disclosed therein, a substantially transparent electrode disposed on a photoconductive surface is developed with toner particles. A photosensor and light source cooperate with one another to determine the intensity of light transmitted through the toner particles deposited on the electrode. This provides an indication of the density of toner particles deposited thereon which corresponds to the concentration of toner particles within the developer mix. When the density is beneath a preselected level, a control system actuates dispenser 76 so as to furnish additional toner particles from hopper 74 to the sump of chamber 54. In this manner, additional toner particles are periodically furnished to the developer mixture contained within chamber 54. This insures that copy density is maintained at the optimum level.

Referring now to FIG. 3, the detailed structure of toner dispensing apparatus 60 will be described hereinafter. As shown therein, dispenser 76 includes a flexible, substantially U-shaped tubular member 78. Tubular member 78 includes legs **78*a* and 78*b* which have a plurality of equally spaced apertures 80 therein. Apertures 80 dispense toner particles passing through legs 78*a* and 78*b* of tube 78. Leg 78*b* has one end portion thereof coupled to aperture 82 in hopper 74. Leg 78*b* has an enlarged slot 84 disposed in aperture 82 for receiving toner particles from hopper 74. Leg 78*a* has an end region thereof disposed in the upper region of hopper 74 and an enlarged slot 85 for dispensing particles into hopper 74. This end region also has a plurality of apertures 81 therein for returning the non-dispensed toner particles to hopper 74**.

Toner particles are advanced through tube 78 by helical member 86. Thus, tube 78 in conjunction with helical member 86 forms an auger system. Rotation of helical member 86 advances toner particles in the direction of arrow 88. Preferably, helical member 86 is a helically wound coil spring disposed interiorly of tube 78. Rotation of helical member 86 advances the toner particles from the region beneath slot 84 to the various dispensing apertures 80 in tube 78. The toner particles are dispensed from apertures 80 as helical member 86 rotates. These particles advance in the direction of arrow 88 and the non-dispensed toner particles are returned to the upper region of hopper 74 by being dispensed from apertures 80 located in the upper region thereof. A drive motor 90 is coupled to helical member 86 at the end portion of leg 78*a* and rotates it so as to advance the toner particles in the direction of arrow 88. Preferably, the apertures or holes in tubular member 78 are arranged in a helical configuration with each hole being approximately ½° from one another.

In recapitulation, it is evident that a closed loop toner dispensing system is employed in the development system. Toner particles are loaded into the auger from the bottom of the hopper and transported through a dispensing zone. The toner particles are dispensed through a set of holes or slits in the tubular shroud of the auger. Thereafter, the non-dispensed toner particles are returned to the top of the hopper. By completing this closed loop path from and to the hopper, the system adds a degree of freedom, the toner transport rate, that was heretofore previously unavailable. In a typical linear configuration, the toner transport rate, equals the toner usage rate. However, in the closed loop system, the dispenser can be operated at a much higher transport rate than the usage rate. This significantly improves toner particle dispensing.

It is, therefore, evident that there has been provided, in accordance with the present invention, a toner dispensing system that fully satisfies the objects, aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An electrophotographic printing machine of the type having an electrostatic latent image recorded on a photoconductive member, wherein the improvement includes:

means for housing a supply of developer material comprising carrier granules and toner particles;

means for depositing toner particles onto the latent image forming a powder image on the photoconductive member;

a hopper defining a chamber having a supply of toner particles therein, said hopper having an aperture for discharging toner particles therefrom;

a flexible, U-shaped tubular member having one end region thereof coupled to the aperture in said hopper for receiving toner particles and the other end region thereof positioned in the upper region of the chamber of said hopper for returning the non-dispensed toner particles thereto, said tubular member having a plurality of substantially equal spaced apertures therein for dispensing the toner particles therefrom into said housing, said tubular member having a slot in the end region thereof coupled to the aperture in said hopper for receiving the toner particles therefrom with the other end region thereof having a plurality of apertures therein for returning non-dispensed toner particles to the chamber of said hopper;

an elongated, flexible helical member disposed interiorly of said tubular member and extending the length thereof; and means for rotating said helical member to advance the toner particles through said tubular member.

* * * * *